US010978856B1

(12) United States Patent
Tanahashi et al.

(10) Patent No.: US 10,978,856 B1
(45) Date of Patent: Apr. 13, 2021

(54) SPARK PLUG

(71) Applicant: NGK Spark Plug Co., Ltd., Nagoya (JP)

(72) Inventors: Yusuke Tanahashi, Nagoya (JP); Naoki Nishio, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 17/067,992

(22) Filed: Oct. 12, 2020

(30) Foreign Application Priority Data

Nov. 12, 2019 (JP) ..... JP2019-204453

(51) Int. Cl.
*H01T 13/36* (2006.01)

(52) U.S. Cl.
CPC ..... *H01T 13/36* (2013.01)

(58) Field of Classification Search
CPC ..... H01T 13/36
See application file for complete search history.

(56) References Cited

U.S. PATENT DOCUMENTS

2011/0181168 A1* 7/2011 Nakamura ..... H01T 13/20 313/144
2011/0298353 A1 12/2011 Nakamura et al.
2012/0267995 A1* 10/2012 Shimamura ..... H01T 13/36 313/143
2013/0015756 A1* 1/2013 Yamada ..... H01T 13/36 313/143
2015/0188293 A1* 7/2015 Ozeki ..... H01T 13/36 313/143
2017/0033538 A1* 2/2017 Kobayashi ..... H01T 13/20
2017/0346259 A1* 11/2017 Kawai ..... H01T 13/36
2017/0358904 A1* 12/2017 Sadaka ..... H01T 13/36

FOREIGN PATENT DOCUMENTS

JP 2010-192184 A 9/2010

* cited by examiner

*Primary Examiner* — Kevin Quarterman
(74) *Attorney, Agent, or Firm* — Kusner & Jaffe

(57) ABSTRACT

A spark plug including a cylindrical insulator having a step portion; a center electrode provided in an axial hole of the insulator; and a cylindrical metal shell having a ledge portion, the metal shell holding the insulator from an outer circumferential side in a state in which the step portion is engaged with the ledge portion via a packing, wherein a recess is formed on a part contacting with the packing, of one of the step portion and the ledge portion, and a projection which at least partially overlaps the recess in the axial-line direction is formed on a part contacting with the packing, of the other of the step portion and the ledge portion.

8 Claims, 8 Drawing Sheets

SPARK PLUG

FIELD OF THE INVENTION

The present invention relates to a spark plug, and in particular, relates to a spark plug with a packing interposed between a metal shell and an insulator.

BACKGROUND OF THE INVENTION

In a spark plug in which an insulator is engaged with a taper portion of a metal shell via a packing, a feature of providing a groove on the taper portion is known (Japanese Laid-Open Patent Publication No. 2010-192184). In the feature of Japanese Laid-Open Patent Publication No. 2010-192184, when the insulator is engaged with the metal shell via the packing, the packing is deformed so that a part of the packing enters the groove, whereby radial-direction movement of the packing relative to the taper portion (metal shell) can be prevented.

Problems to be Solved by the Invention

However, in the above feature, when the insulator is engaged with the metal shell via the packing, the insulator might move in the radial direction relative to the packing. If the insulator moves in the radial direction relative to the packing, the insulator becomes eccentric from the metal shell. As a result, discharge (hereinafter, referred to as "side spark") between the metal shell and the insulator becomes more likely to occur at a part where the distance between the inner circumferential surface of the metal shell and the outer circumferential surface of the insulator is short, thus often leading to misfire.

SUMMARY OF THE INVENTION

The present invention has been made to solve the above problem, and an object of the present invention is to provide a spark plug that can prevent the insulator from being eccentric from the metal shell.

Means for Solving the Problems

To attain the above object, a spark plug of the present invention includes: a cylindrical insulator having an axial hole extending in a direction of an axial line from a front side to a rear side, the insulator having, on an outer circumference thereof, a step portion of which an outer diameter reduces toward the front side in the axial-line direction; a center electrode provided in the axial hole; and a cylindrical metal shell having, on an inner circumference thereof, a ledge portion of which an inner diameter reduces toward the front side in the axial-line direction, the metal shell holding the insulator from an outer circumferential side in a state in which the step portion is engaged with the ledge portion via a packing, wherein a recess is formed on a part contacting with the packing, of one of the step portion and the ledge portion, and a projection which at least partially overlaps the recess in the axial-line direction is formed on a part contacting with the packing, of the other of the step portion and the ledge portion.

Effects of the Invention

In the spark plug according to a first aspect, the recess is formed on a part contacting with the packing, of one of the step portion of the insulator and the ledge portion of the metal shell, and the projection which at least partially overlaps the recess in the axial-line direction is formed on a part contacting with the packing, of the other of the step portion and the ledge portion. When the insulator is engaged with the metal shell via the packing, the projection is thrusted into the packing and a part of the packing pushed by the projection enters the recess. Therefore, radial-direction movement of the packing relative to the ledge portion is prevented, whereby radial-direction movement of the insulator relative to the packing can be prevented. Thus, the insulator can be prevented from being eccentric from the metal shell.

In the spark plug according to a second aspect, a height of the projection is smaller than a depth of the recess. Therefore, a load applied to the projection thrusted into the packing can be reduced as compared to the case where the height of the projection is greater than the depth of the recess. Thus, in addition to the effects of the first aspect, the step portion or the ledge portion on which the projection is formed can be prevented from being broken.

In the spark plug according to a third aspect, a minimum value of a radial-direction thickness of the insulator at a position of the recess formed on the step portion (insulator) is greater than a radial-direction thickness of the insulator on an inner side of a part closest to the axial line, of an inner circumference of the metal shell on the front side with respect to the recess. Thus, in addition to the effects of the first or second aspect, insulation breakdown through the insulator at the position of the recess can be less likely to occur.

In the spark plug according to a fourth aspect, the recess is formed on the ledge portion (metal shell). Thus, in addition to the effects of the first or second aspect, breakage of the ledge portion due to tensile stress caused in the ledge portion by a part of the packing entering the recess can be prevented.

In the spark plug according to a fifth aspect, a center of the recess in a radial direction of the ledge portion is positioned on a radially outer side with respect to a center in the radial direction of the ledge portion. Therefore, the distance between the base part of the ledge portion and the recess can be shortened, whereby the moment of force acting on the recess can be reduced when the insulator (step portion) is engaged with the metal shell (ledge portion) via the packing. Thus, in addition to the effects of the fourth aspect, the ledge portion can be less likely to be broken.

In the spark plug according to a sixth aspect, a metal member is sandwiched between a base material of the packing and the recess formed on one of the step portion and the ledge portion. Vickers hardness of the metal member is lower than Vickers hardness of the base material. Therefore, when the insulator is engaged with the metal shell via the packing, the metal member can closely contact with the step portion or the ledge portion on which the recess is formed. Thus, in addition to the effects of any one of the first to fifth aspects, airtightness of the packing can be improved and the thermal resistance of the packing can be reduced owing to the metal member.

In the spark plug according to a seventh aspect, a metal layer is formed on at least a part of a surface of the base material. The metal layer is sandwiched between the base material and one of the step portion and the ledge portion on which the recess is formed. Vickers hardness of the metal layer is lower than Vickers hardness of the base material. Therefore, when the insulator is engaged with the metal shell via the packing, the metal layer can closely contact with the step portion or the ledge portion on which the recess is formed. Accordingly, the contact area between the metal layer and the step portion or the ledge portion can be increased. Thus, in addition to the effects of any one of the first to sixth aspects, airtightness by the packing can be improved and the thermal resistance of the packing can be reduced.

In the spark plug according to an eighth aspect, an edge and a corner of each of the recess and the projection are chamfered to be rounded. Therefore, occurrence of cracking starting from the edge or the corner of the recess or the projection can be prevented. Thus, in addition to the effects of any one of the first to seventh aspects, the step portion and the ledge portion can be less likely to be broken.

DETAILED DESCRIPTION OF THE INVENTION

Figure 1:
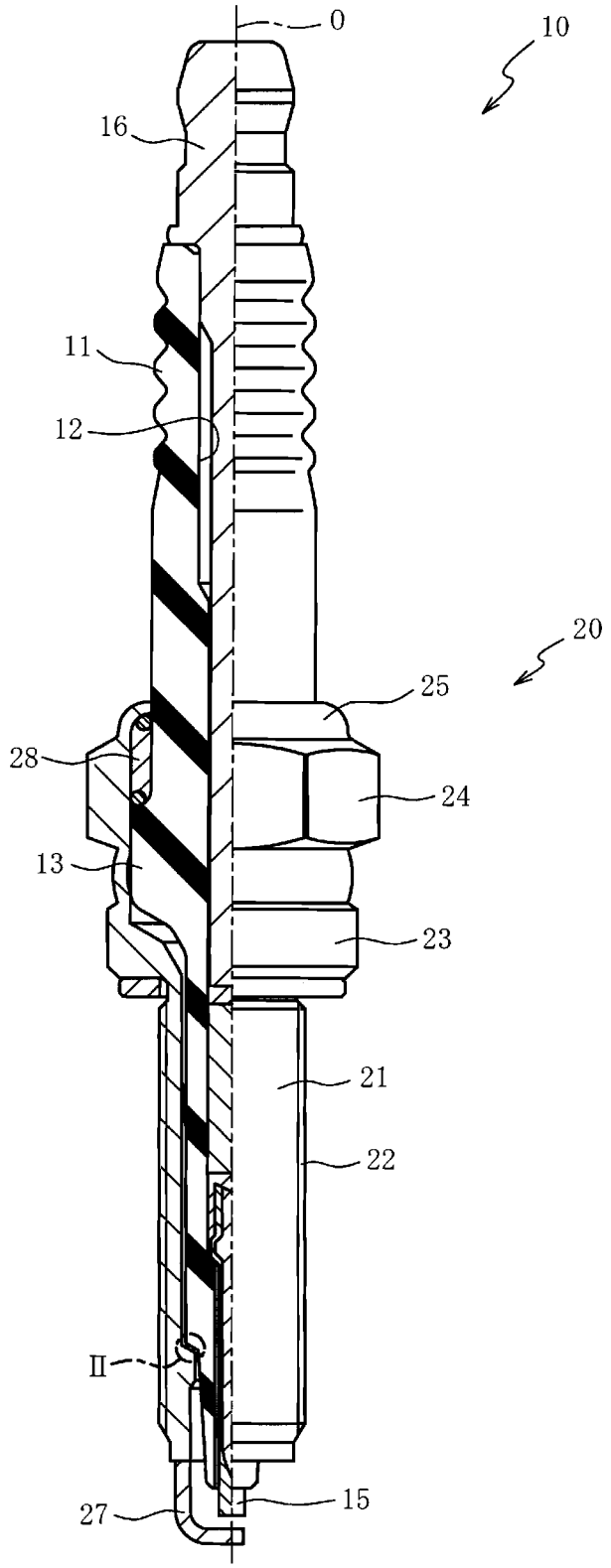
FIG. 1 is a half-sectional view of a spark plug according to the first embodiment.
Figure 2:
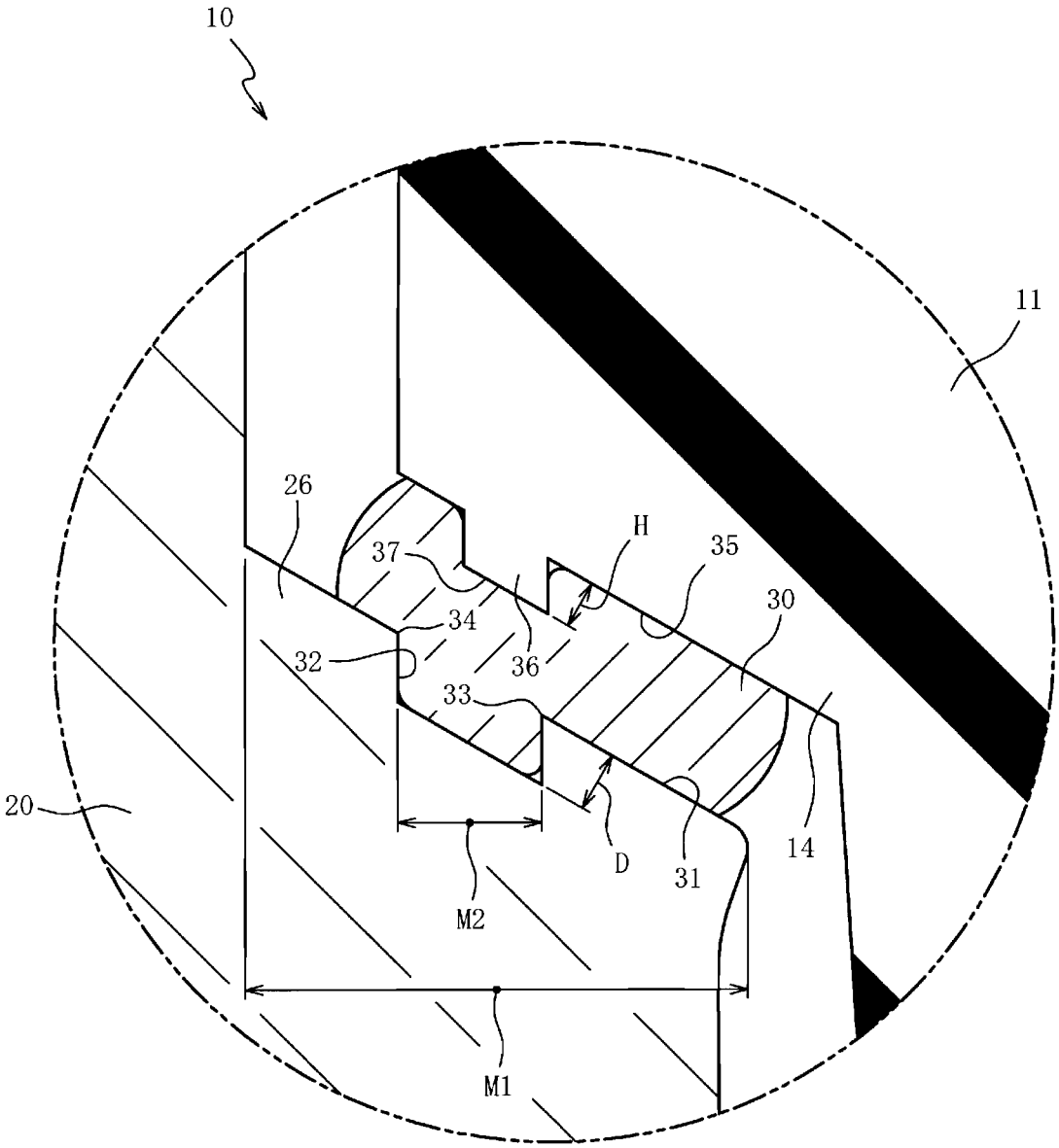
FIG. 2 is a partially enlarged sectional view of the spark plug at part indicated by II in FIG. 1.

Hereinafter, preferred embodiments of the present invention will be described with reference to the accompanying drawings. FIG. 1 is a half-sectional view of a spark plug 10 according to the first embodiment, with an axial line O as a boundary. FIG. 2 is a partially enlarged sectional view of the spark plug 10 at part indicated by II in FIG. 1. In FIG. 1, the lower side on the drawing sheet is referred to as a front side of the spark plug 10, and the upper side on the drawing sheet is referred to as a rear side of the spark plug 10 (the same applies in the other figures). As shown in FIG. 1, the spark plug 10 includes an insulator 11, a metal shell 20, and a packing 30.

The insulator 11 is a substantially cylindrical member made from, for example, alumina which is excellent in insulation property under high temperature and in mechanical property. The insulator 11 has an axial hole 12 extending along the axial line O. The insulator 11 has, almost at the center in the axial-line direction, an annular protruding portion 13 protruding radially outward. The insulator 11 has, on the outer circumference on the front side with respect to the protruding portion 13, a step portion 14 (see FIG. 2) of which the outer diameter reduces toward the front side in the axial-line direction. A center electrode 15 is provided on the front side of the axial hole 12 of the insulator 11.

The center electrode 15 is a bar-shaped electrode held by the insulator 11 along the axial line O. The center electrode 15 is formed such that a core material having excellent thermal conductivity is embedded in a base material. The base material is formed from a metal material made of Ni or an alloy containing Ni as a main component, and the core material is formed from copper or an alloy containing copper as a main component. The core material may be omitted.

The center electrode 15 is electrically connected to a metal terminal 16 in the axial hole 12 of the insulator 11. The metal terminal 16 is a bar-shaped member to which a high-voltage cable (not shown) is connected, and is formed from a conductive metal material (e.g., low-carbon steel).

The metal shell 20 is a substantially cylindrical member formed from a conductive metal material (e.g., low-carbon steel). The metal shell 20 includes a front end portion 21 surrounding a part of the insulator 11 on the front side with respect to the protruding portion 13, a seat portion 23 contiguous to the rear side of the front end portion 21, a tool engagement portion 24 located on the rear side of the seat portion 23, and a rear end portion 25 contiguous to the rear side of the tool engagement portion 24. The front end portion 21 has, on the outer circumferential surface, an external thread 22 formed over almost the entire axial-line-direction length of the front end portion 21 and configured to be screwed into a screw hole of an engine (not shown). The front end portion 21 has, on the inner circumference thereof, a ledge portion 26 (see FIG. 2) of which the inner diameter reduces toward the front side in the axial-line direction.

The seat portion 23 is a part for restricting the screwed amount of the external thread 22 to the engine and closing a gap between the external thread 22 and the screw hole. The tool engagement portion 24 is a part with which a tool such as a wrench is to be engaged when the external thread 22 is screwed into the screw hole of the engine. The rear end portion 25 is an annular part bending toward the radially inner side. The rear end portion 25 is located on the rear side with respect to the protruding portion 13 of the insulator 11.

A ground electrode 27 is a bar-shaped member made of metal (e.g., nickel-based alloy) and connected to the front end portion 21 of the metal shell 20. The ground electrode 27 forms a spark gap between the ground electrode 27 and the center electrode 15. A seal portion 28 filled with powder of talc or the like is provided over the entire circumference between the protruding portion 13 of the insulator 11 and the rear end portion 25 of the metal shell 20.

As shown in FIG. 2, a packing 30 is interposed between the step portion 14 of the insulator 11 and the ledge portion 26 of the metal shell 20. The packing 30 is an annular plate member formed from a softer metal material such as iron or steel than the metal material forming the metal shell 20.

In a process for manufacturing the spark plug 10, the metal shell 20 is attached to the insulator 11 with the packing 30 located between the ledge portion 26 of the metal shell 20 and the step portion 14 of the insulator 11. A part from the ledge portion 26 to the rear end portion 25 (see FIG. 1) of the metal shell 20 applies an axial-line-direction compressive load to a part from the step portion 14 to the protruding portion 13 of the insulator 11 via the packing 30 and the seal portion 28. As a result, the metal shell 20 holds the insulator 11, and an axial-line-direction compressive load is applied to the packing 30. The step portion 14 of the insulator 11 is engaged with the ledge portion 26 of the metal shell 20 via the packing 30.

A recess 32 is formed on, of the ledge portion 26 of the metal shell 20, a part (hereinafter, referred to as "first portion 31") contacting with the packing 30. In the present embodiment, the recess 32 is a groove having a quadrangular sectional shape and formed continuously over the entire circumference of the first portion 31.

A projection 36 which at least partially overlaps the recess 32 in the axial-line direction is formed on, of the step portion 14 of the insulator 11, a part (hereinafter, referred to as "second portion 35") contacting with the packing 30. In the present embodiment, the projection 36 is a ridge having a quadrangular sectional shape and formed continuously over the entire circumference of the second portion 35. An end surface 37 of the projection 36 is a slope surface sloped relative to the axial line O (see FIG. 1). The end surface 37 is sloped so as to become closer to the front side as approaching the radially inner side, and the end surface 37 is formed in parallel to the first portion 31.

Since the projection 36 at least partially overlaps the recess 32 in the axial-line direction, when the step portion 14 of the insulator 11 is engaged with the ledge portion 26 of the metal shell 20 via the packing 30, the projection 36 is thrusted into the packing 30, and a part of the packing 30 pushed by the projection 36 enters the recess 32. Thus, radial-direction movement of the packing 30 relative to the ledge portion 26 is prevented, whereby radial-direction movement of the insulator 11 relative to the packing 30 can be prevented. Therefore, the insulator 11 can be prevented from being eccentric from the metal shell 20. As a result, it is possible to prevent occurrence of side spark which is likely to occur at a part where the spatial distance between the metal shell 20 and the insulator 11 is short.

Since the projection 36 is thrusted into the packing 30 and a part of the packing 30 enters the recess 32, the packing 30 can be prevented from moving in the radial direction when the step portion 14 of the insulator 11 is engaged with the ledge portion 26 of the metal shell 20 via the packing 30. Thus, breakage of the insulator 11 due to the packing 30 moving in the radial direction to press the insulator 11 can be prevented.

Since the end surface 37 of the projection 36 is parallel to the first portion 31, when the insulator 11 moves in the axial-line direction relative to the metal shell 20 so that the projection 36 is thrusted into the packing 30, a force of moving the packing 30 in the radial direction (radial-direction reaction force acting on the end surface 37) can be reduced. Thus, radial-direction movement of the packing 30 can be further prevented.

When the step portion 14 of the insulator 11 is engaged with the ledge portion 26 of the metal shell 20 via the packing 30, since radial-direction movement of the packing 30 can be prevented, an axial-line-direction compressive load applied to the packing 30 can be increased. As a result, airtightness by the packing 30 can be improved.

When the axial-line-direction compressive load applied to the packing 30 is increased, the areas of the first portion 31 and the second portion 35 that contact with the packing 30 become large and the thickness of the packing 30 is reduced. Since the thermal resistance of the packing 30 is proportional to the thickness of the packing 30 and inversely proportional to the area of the packing 30, the thermal resistance of the packing 30 can be reduced. Thus, the amount of heat flow transferring from the insulator 11 through the packing 30 to the metal shell 20 can be increased, whereby it can be expected that pre-ignition in which the insulator 11 acts as an ignition source is prevented.

A height H of the projection 36 from the second portion 35 is smaller than a depth D of the recess 32 from the first portion 31. Thus, a load applied to the projection 36 thrusted into the packing 30 can be reduced as compared to the case where the height H of the projection 36 is greater than the depth D of the recess 32. Therefore, breakage of the step portion 14 on which the projection 36 is formed can be prevented.

The volume of the projection 36 is smaller than the volume of the recess 32, and therefore a part of the packing 30 deformed due to the projection 36 being thrusted into the packing 30 can be stored in the recess 32. As a result, the volume of the packing 30 protruding in the radial direction without being stored in the recess 32 can be reduced, whereby breakage of the insulator 11 due to the packing 30 protruding in the radial direction and pressing the insulator 11 can be prevented.

Since the recess 32 is formed on the ledge portion 26 of the metal shell 20, breakage of the ledge portion 26 due to tensile stress caused by a part of the packing 30 entering the recess 32 can be prevented as compared to the case where the recess 32 is formed on the step portion 14 of the insulator 11.

A center M2 of the recess 32 in the radial direction (left-right direction in FIG. 2) of the ledge portion 26 is positioned on the radially outer side with respect to a center M1 in the radial direction of the ledge portion 26. There is a possibility that the recess 32 becomes a start point of breakage of the ledge portion 26. However, since the center M2 of the recess 32 in the radial direction is set on the radially outer side with respect to the center M1 in the radial direction of the ledge portion 26, the distance between the base part of the ledge portion 26 and the recess 32 can be shortened. Thus, the moment of force acting on the recess 32 can be reduced when the step portion 14 is engaged with the ledge portion 26 via the packing 30. Therefore, the ledge portion 26 can be less likely to be broken.

The center M1 in the radial direction of the ledge portion 26 is equal to the position of the midpoint of a segment connecting a part of the ledge portion 26 that is closest to the axial line O (see FIG. 1) and the radially outer end of the ledge portion 26. The center M2 in the radial direction of the recess 32 is equal to the position of the midpoint of a segment connecting a radially inner edge 33 of the recess 32 and a radially outer edge 34 of the recess 32.

Figure 3:
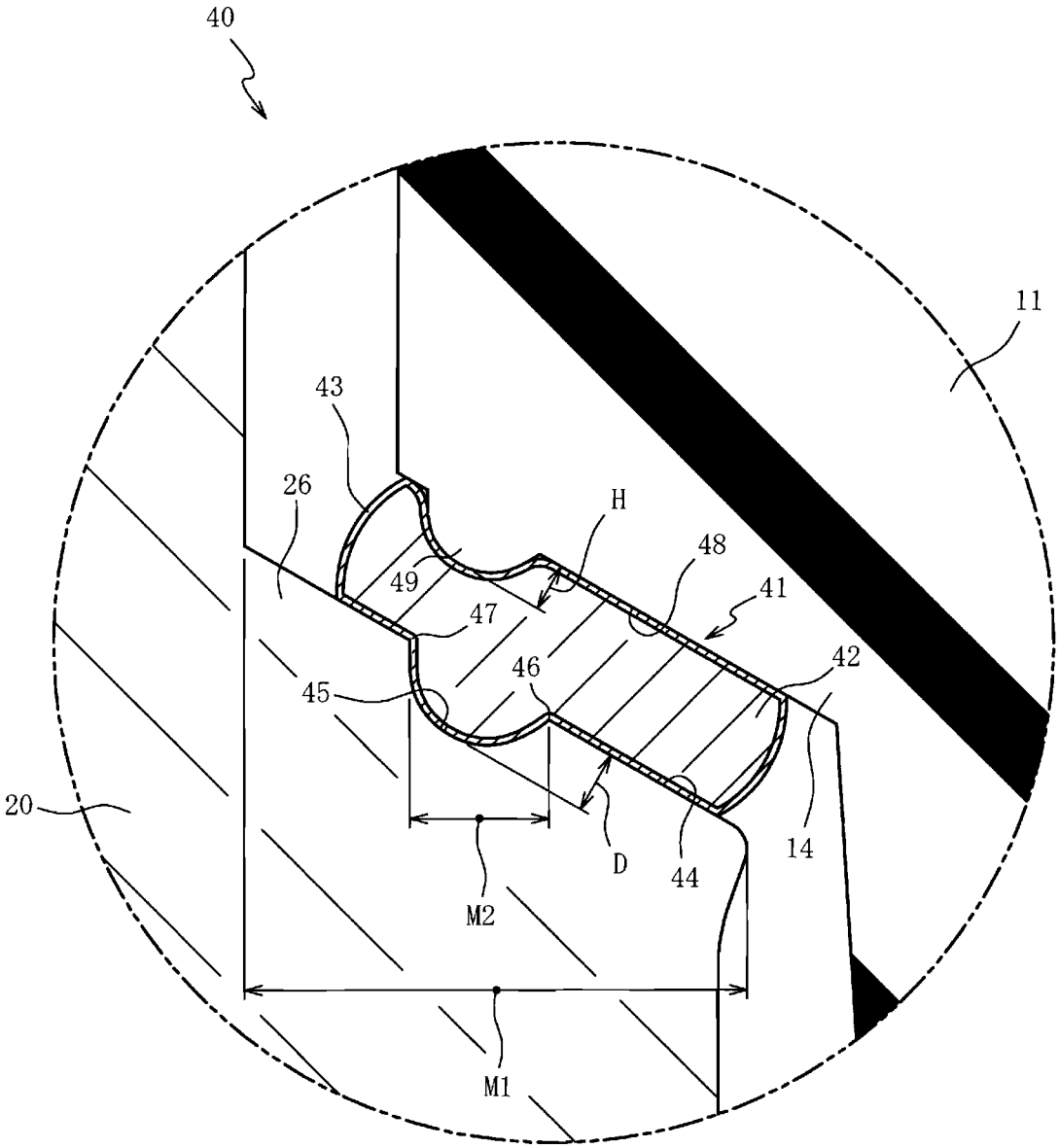
FIG. 3 is a partial sectional view of a spark plug according to the second embodiment.

With reference to FIG. 3, the second embodiment will be described. In the second embodiment, the case where a metal layer 43 is provided on the surface of a packing 41 will be described. The same parts as those described in the first embodiment are denoted by the same reference characters and description thereof will not be repeated below. FIG. 3 is a partial sectional view including the axial line O of a spark plug 40 according to the second embodiment, and as in FIG. 2, the part indicated by II in FIG. 1 is shown in an enlarged manner (the same applies in FIGS. 4 to 8).

As shown in FIG. 3, in the spark plug 40, the packing 41 is interposed between the step portion 14 of the insulator 11 and the ledge portion 26 of the metal shell 20. The packing 41 includes a base material 42 and the metal layer 43 formed on the surface of the base material 42. The base material 42 is an annular plate member formed from a metal material such as iron or steel. The metal layer 43 includes a softer metal material such as Zn, Cu, Al, or Sn than the metal material forming the base material 42. The metal layer 43 is formed on the surface of the base material 42 by plating, spraying, vapor deposition, chemical treatment, or the like. As a matter of course, the metal layer 43 may be provided in a multilayer form by performing chromate treatment on a surface of Zn, for example.

The Vickers hardness of the metal layer 43 is lower than the Vickers hardness of the base material 42. The Vickers hardness is measured on the basis of JIS Z2244: 2009. The Vickers hardness of each of the base material 42 and the metal layer 43 is measured by disassembling the spark plug 40 and taking out the packing 41. In the case of the packing 41 in which the surface of the base material 42 is entirely covered by the metal layer 43, the metal layer 43 is removed by polishing or the like to expose the base material 42, whereby the Vickers hardness of the base material 42 is measured.

A recess 45 is formed on, of the ledge portion 26 of the metal shell 20, a first portion 44 contacting with the packing 41. In the present embodiment, the recess 45 is a groove having a semicircular sectional shape and formed continuously over the entire circumference of the first portion 44. A projection 49 which at least partially overlaps the recess 45 in the axial-line direction is formed on, of the step portion 14 of the insulator 11, a second portion 48 contacting with the packing 41. In the present embodiment, the projection 49 is a ridge having a semicircular sectional shape and formed continuously over the entire circumference of the second portion 48.

When the step portion 14 of the insulator 11 is engaged with the ledge portion 26 of the metal shell 20 via the packing 41, the projection 49 is thrusted into the packing 41, and a part of the packing 41 pushed by the projection 49 enters the recess 45. Thus, radial-direction movement of the packing 41 relative to the ledge portion 26 is prevented, whereby radial-direction movement of the insulator 11 relative to the packing 41 can be prevented.

Since the recess 45 and the projection 49 have semicircular sectional shapes, stress concentration on the recess 45 and the projection 49 can be prevented. Thus, occurrence of cracking caused due to the recess 45 and the projection 49 can be prevented, whereby the step portion 14 and the ledge portion 26 can be less likely to be broken.

The metal layer 43 of the packing 41 is sandwiched between the base material 42 and the ledge portion 26 on which the recess 45 is formed. The thickness of the metal layer 43 is smaller than the depth D of the recess 45, and therefore the base material 42 and the metal layer 43 partially enter the recess 45. Since the Vickers hardness of the metal layer 43 is lower than the Vickers hardness of the base material 42, the metal layer 43 can closely contact with the ledge portion 26 on which the recess 45 is formed, when the insulator 11 is engaged with the metal shell 20 via the packing 41. The contact area between the soft metal layer 43 and the ledge portion 26 can be enlarged, whereby airtightness by the packing 41 can be improved and the thermal resistance of the packing 41 can be reduced.

A height H of the projection 49 from the second portion 48 is smaller than a depth D of the recess 45 from the first portion 44. A center M2 of the recess 45 in the radial direction (left-right direction in FIG. 3) of the ledge portion 26 is positioned on the radially outer side with respect to the center M1 in the radial direction of the ledge portion 26. The center M2 in the radial direction of the recess 45 is equal to the position of the midpoint of a segment connecting a radially inner edge 46 of the recess 45 and a radially outer edge 47 of the recess 45. These configurations are the same as those of the spark plug 10 in the first embodiment, and the effects based on these configurations are the same as those in the first embodiment.

Figure 4:
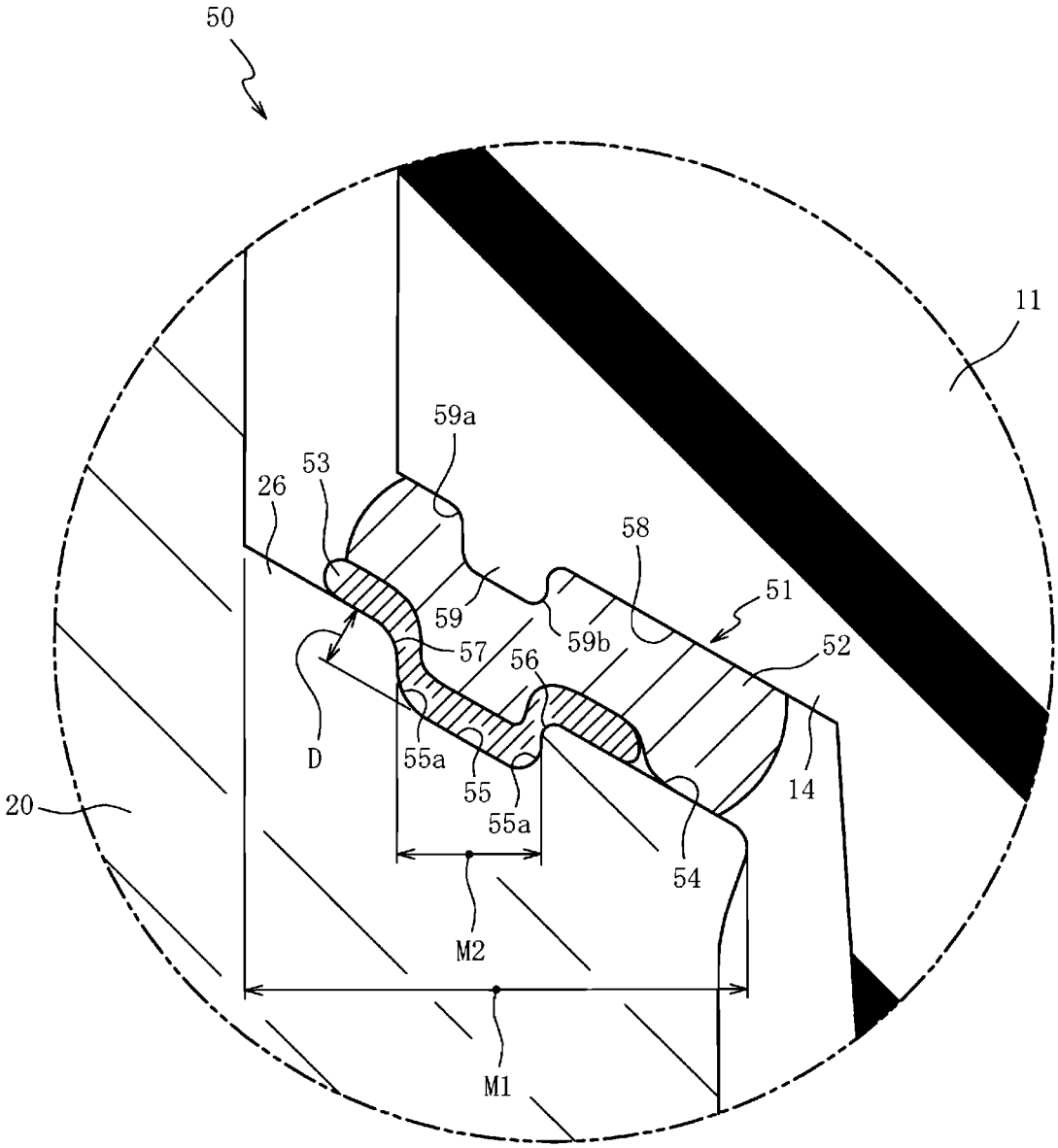
FIG. 4 is a partial sectional view of a spark plug according to the third embodiment.

With reference to FIG. 4, the third embodiment will be described. In the second embodiment, the case of using the packing 41 in which the metal layer 43 is formed on the surface of the base material 42, has been described. On the other hand, in the third embodiment, the case of using a packing 51 in which a metal member 53 is overlaid on a base material 52, will be described. The same parts as those described in the first embodiment are denoted by the same reference characters and description thereof will not be repeated below. FIG. 4 is a partial sectional view including the axial line O of a spark plug 50 according to the third embodiment.

As shown in FIG. 4, in the spark plug 50, the packing 51 is interposed between the step portion 14 of the insulator 11 and the ledge portion 26 of the metal shell 20. The packing 51 includes the base material 52 and the metal member 53 overlaid on the base material 52. The base material 52 is an annular plate member formed from a metal material such as iron or steel. The metal member 53 is an annular plate member including a softer metal material such as Zn, Cu, Al, or Sn than the metal material forming the base material 52. The Vickers hardness of the metal member 53 is lower than the Vickers hardness of the base material 52. The Vickers hardness is measured on the basis of JIS Z2244: 2009. The Vickers hardness is measured by disassembling the spark plug 50 and taking out the packing 51.

A recess 55 is formed on, of the ledge portion 26 of the metal shell 20, a first portion 54 contacting with the packing 51. In the present embodiment, the recess 55 is a groove having a quadrangular sectional shape and formed continuously over the entire circumference of the first portion 54. A radially inner edge 56 of the recess 55, a radially outer edge 57 of the recess 55, and corners 55*a* of the recess 55 are chamfered to be rounded. The metal member 53 contacts with the first portion 54. A depth D of the recess 55 is greater than the thickness of the metal member 53. Therefore, a part of the metal member 53 and a part of the base material 52 enter the recess 55.

A projection 59 which at least partially overlaps the recess 55 in the axial-line direction is formed on, of the step portion 14 of the insulator 11, a second portion 58 contacting with the packing 51. In the present embodiment, the projection 59 is a ridge having a semicircular sectional shape and formed continuously over the entire circumference of the second portion 58. A corner 59*a* of the projection 59 and an edge 59*b* of the projection 59 are chamfered to be rounded.

When the step portion 14 of the insulator 11 is engaged with the ledge portion 26 of the metal shell 20 via the packing 51, the projection 59 is thrusted into the base material 52, and the metal member 53 and the base material 52 pushed by the projection 59 partially enter the recess 55. Thus, radial-direction movement of the packing 51 relative to the ledge portion 26 is prevented, whereby radial-direction movement of the insulator 11 relative to the packing 51 can be prevented.

Since the recess 55 and the projection 59 are formed such that the edges 56, 57, 59*b* and the corners 55*a*, 59*a* are chamfered to be rounded, stress concentration on the edges 56, 57, 59*b* and the corners 55*a*, 59*a* is prevented, whereby occurrence of cracking starting from the edge 56, 57, 59*b* or the corner 55*a*, 59*a* can be prevented. Thus, the step portion 14 and the ledge portion 26 can be less likely to be broken.

Since the Vickers hardness of the metal member 53 sandwiched between the recess 55 and the base material 52 is lower than the Vickers hardness of the base material 52, the metal member 53 can closely contact with the ledge portion 26 on which the recess 55 is formed, when the insulator 11 is engaged with the metal shell 20 via the packing 51. Therefore, airtightness by the packing 51 can be improved and the thermal resistance of the packing 51 can be reduced owing to the metal member 53.

A center M2 of the recess 55 in the radial direction (left-right direction in FIG. 4) of the ledge portion 26 is positioned on the radially outer side with respect to a center M1 in the radial direction of the ledge portion 26. The center M2 of the recess 55 is equal to the position of the midpoint of a segment connecting the radially inner edge 56 of the recess 55 and the radially outer edge 57 of the recess 55. Here, both ends of the segment are intersections (chamfer center) of extension lines of two lines forming each edge 56, 57. This configuration is the same as that of the spark plug 10 in the first embodiment, and the effects based on this configuration are the same as those in the first embodiment.

Figure 5:
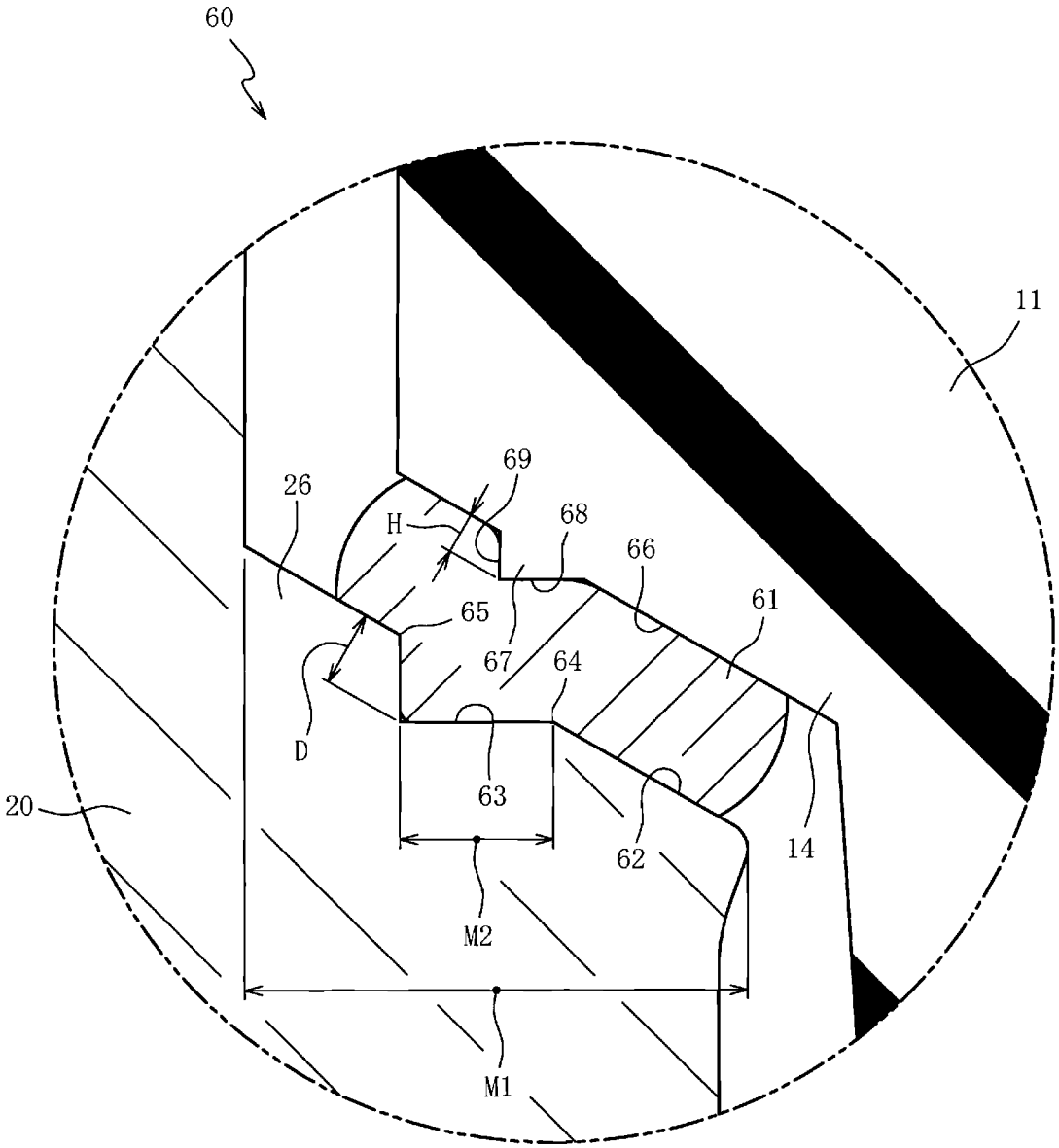
FIG. 5 is a partial sectional view of a spark plug according to the fourth embodiment.

With reference to FIG. 5, the fourth embodiment will be described. In the first embodiment, the case where the recess 31 and the projection 36 have quadrangular sectional shapes, has been described. On the other hand, in the fourth embodiment, the case where a recess 63 and a projection 67 have triangular sectional shapes, will be described. The same parts as those described in the first embodiment are denoted by the same reference characters and description thereof will not be repeated below. FIG. 5 is a partial sectional view including the axial line O of a spark plug 60 according to the fourth embodiment.

As shown in FIG. 5, in the spark plug 60, a packing 61 is interposed between the step portion 14 of the insulator 11 and the ledge portion 26 of the metal shell 20. The packing 61 is an annular plate member formed from a metal material such as iron or steel. The recess 63 is formed on, of the ledge portion 26 of the metal shell 20, a first portion 62 contacting with the packing 61. In the present embodiment, the recess 63 is an L-shaped groove having a triangular sectional shape and formed continuously over the entire circumference of the first portion 62. Of two lines representing the recess 63 in a cross section including the axial line O (see FIG. 1), the line connecting to a radially inner edge 64 of the recess 63 is perpendicular to the axial line O, and the line connecting to a radially outer edge 65 of the recess 63 is parallel to the axial line O.

A projection 67 which at least partially overlaps the recess 63 in the axial-line direction is formed on, of the step portion 14 of the insulator 11, a second portion 66 contacting with the packing 61. In the present embodiment, the projection 67 is a ridge having a triangular sectional shape and formed continuously over the entire circumference of the second portion 66. An end surface 68 of the projection 67 is perpendicular to the axial line O (see FIG. 1). In the cross section including the axial line O, a side surface 69 of the projection 67 is parallel to the axial line O.

When the step portion 14 of the insulator 11 is engaged with the ledge portion 26 of the metal shell 20 via the packing 61, the projection 67 is thrusted into the packing 61, and a part of the packing 61 pushed by the projection 67 enters the recess 63. Thus, radial-direction movement of the packing 61 relative to the ledge portion 26 is prevented, whereby radial-direction movement of the insulator 11 relative to the packing 61 can be prevented.

When the insulator 11 moves in the axial-line direction relative to the metal shell 20 so that the projection 67 is thrusted into the packing 61, first, an edge formed by the end surface 68 and the side surface 69 of the projection 67 is thrusted into the packing 61, to restrict radial-direction movement of the packing 61 relative to the projection 67. As the projection 67 is thrusted into the packing 61, the end surface 68 of the projection 67 and the second portion 66 press a part of the packing 61 against a surface of the recess 63 that is parallel to the axial line O (see FIG. 1), so that radial-direction movement of the packing 61 relative to the recess 63 is restricted. Therefore, radial-direction movement of the packing 61 can be further prevented.

A height H of the projection 67 from the second portion 66 is smaller than a depth D of the recess 63 from the first portion 62. A center M2 of the recess 63 in the radial direction (left-right direction in FIG. 5) of the ledge portion 26 is positioned on the radially outer side with respect to the center M1 in the radial direction of the ledge portion 26. The center M2 in the radial direction of the recess 63 is equal to the position of the midpoint of a segment connecting the edge 64, 65 of the recess 63. These configurations are the same as those of the spark plug 10 in the first embodiment, and the effects based on these configurations are the same as those in the first embodiment.

Figure 6:
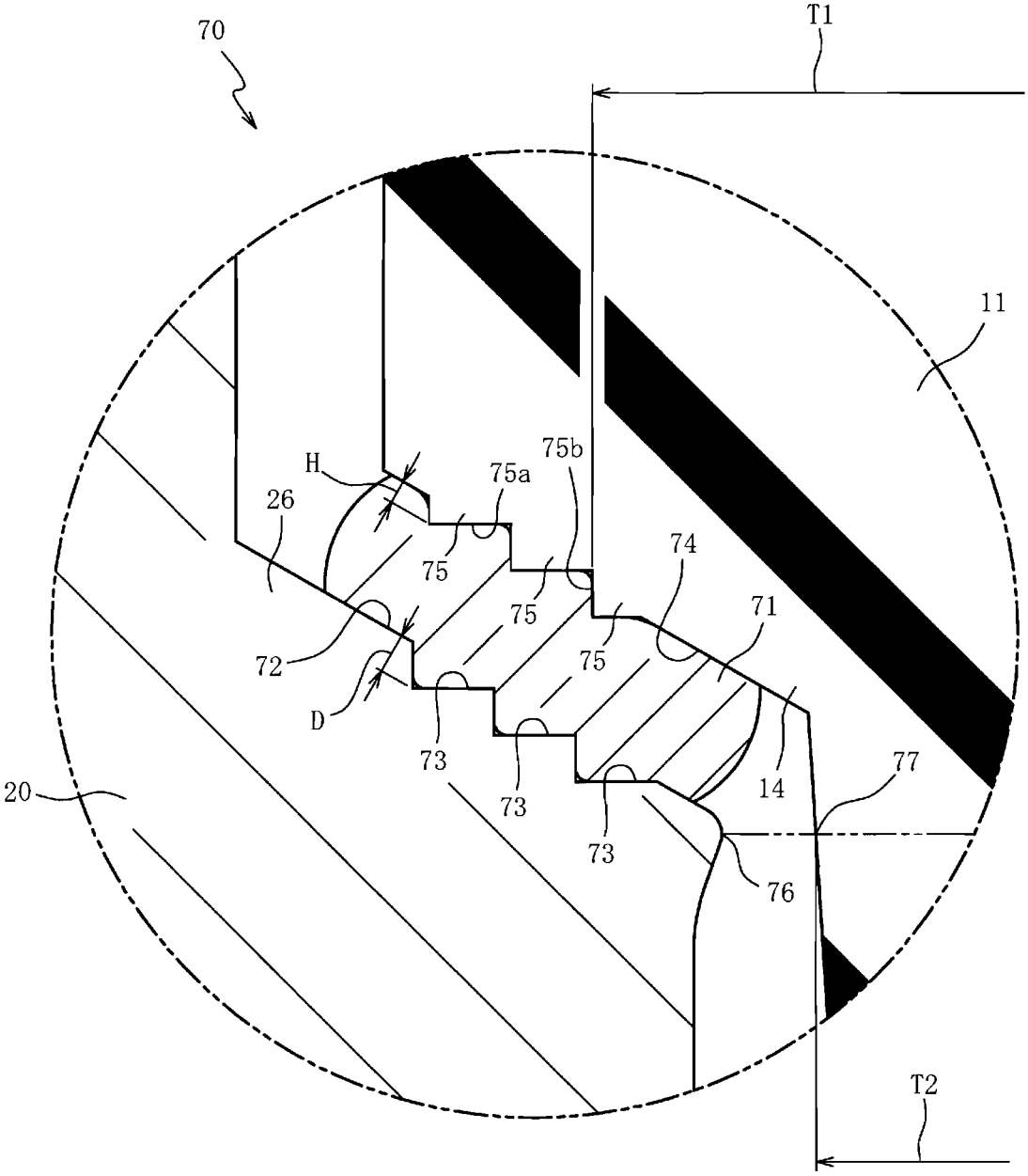
FIG. 6 is a partial sectional view of a spark plug according to the fifth embodiment.

With reference to FIG. 6, the fifth embodiment will be described. In the first to fourth embodiments, the case where one recess 32, 45, 55, 63 and one projection 36, 49, 59, 67 are formed has been described. On the other hand, in the fifth embodiment, the case where a plurality of recesses 73 and a plurality of projections 75 are formed will be described. The same parts as those described in the first embodiment are denoted by the same reference characters and description thereof will not be repeated below. FIG. 6 is a partial sectional view including the axial line O of a spark plug 70 according to the fifth embodiment.

As shown in FIG. 6, in the spark plug 70, a packing 71 is interposed between the step portion 14 of the insulator 11 and the ledge portion 26 of the metal shell 20. The packing 71 is an annular plate member formed from a metal material such as iron or steel. A plurality of recesses 73 are formed on, of the ledge portion 26 of the metal shell 20, a first portion 72 contacting with the packing 71. In the present embodiment, each recess 73 is an L-shaped groove having a triangular sectional shape and formed continuously over the entire circumference of the first portion 72. The plurality of recesses 73 are provided concentrically about the axial line O (see FIG. 1). In the cross section including the axial line O, one of two lines representing each recess 73 is perpendicular to the axial line O and the other one is parallel to the axial line O.

A plurality of projections 75 which at least partially overlap the recesses 73 in the axial-line direction are formed on, of the step portion 14 of the insulator 11, a second portion 74 contacting with the packing 71. In the present embodiment, each projection 75 is a ridge having a triangular sectional shape and formed continuously over the entire circumference of the second portion 74. The plurality of projections 75 are provided concentrically about the axial line O (see FIG. 1). An end surface 75*a* of each projection 75 is perpendicular to the axial line O. In the cross section including the axial line O, a side surface 75*b* of each projection 75 is parallel to the axial line O.

When the step portion 14 of the insulator 11 is engaged with the ledge portion 26 of the metal shell 20 via the packing 71, the projections 75 are thrusted into the packing 71, and a part of the packing 71 pushed by the projections 75 enters the recesses 73. Thus, radial-direction movement of the packing 71 relative to the ledge portion 26 is prevented, whereby radial-direction movement of the insulator 11 relative to the packing 71 can be prevented.

A minimum value T1 in the thickness direction of the insulator 11 at the position of the projections 75 is the radial-direction distance between the axial hole 12 (see FIG. 1) and the side surface 75*b* closest to the axial hole 12. The minimum value T1 is greater than a thickness T2 of the insulator 11 at an intersection 77 of the outer circumferential surface of the insulator 11 and a line perpendicular to the axial line O (see FIG. 1) and passing through a part 76 closest to the axial line O, of the inner circumference of the metal shell 20 on the front side with respect to the recesses 73. The thickness T2 is the radial-direction distance between the intersection 77 and the axial hole 12. Since T1>T2 is satisfied, the radial-direction thickness of the insulator 11 at the projections 75 can be ensured, and thus insulation breakdown through the insulator 11 at the position of the projections 75 can be less likely to occur.

Since a plurality of recesses 73 and a plurality of projections 75 are formed, the contact area between the packing 71 and the first portion 72 or the second portion 74 can be increased. The thermal resistance of the packing 71 is inversely proportional to the area of the packing 71. Therefore, owing to presence of a plurality of recesses 73 and a plurality of projections 75, the thermal resistance of the packing 71 can be reduced. Thus, the amount of heat flow transferring from the insulator 11 through the packing 71 to the metal shell 20 can be increased, whereby it can be expected that pre-ignition in which the insulator 11 acts as an ignition source is prevented.

A height H of each projection 75 from the second portion 74 is smaller than a depth D of each recess 73 from the first portion 72. This configuration is the same as that of the spark plug 10 in the first embodiment, and the effects based on this configuration is the same as that in the first embodiment.

Figure 7:
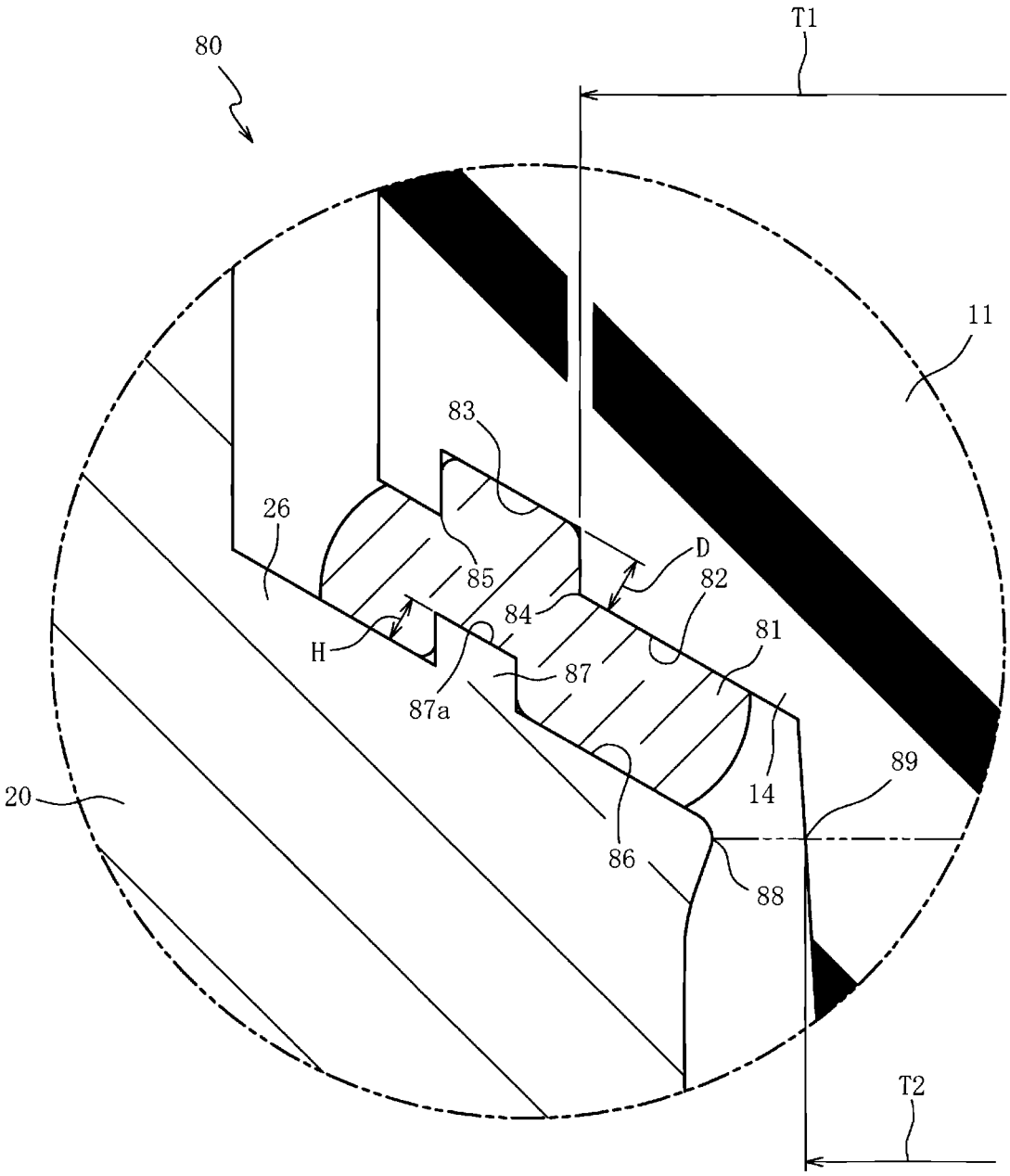
FIG. 7 is a partial sectional view of a spark plug according to the sixth embodiment.

With reference to FIG. 7, the sixth embodiment will be described. In the first to fifth embodiments, the case where the recess 32, 45, 55, 63, 73 is formed on the metal shell 20 and the projection 36, 49, 59, 67, 75 is formed on the insulator 11, has been described. On the other hand, in the sixth embodiment, the case where a recess 83 is formed on the insulator 11 and a projection 87 is formed on the metal shell 20, will be described. The same parts as those described in the first embodiment are denoted by the same reference characters and description thereof will not be repeated below. FIG. 7 is a partial sectional view including the axial line O of a spark plug 80 according to the sixth embodiment.

As shown in FIG. 7, in the spark plug 80, a packing 81 is interposed between the step portion 14 of the insulator 11 and the ledge portion 26 of the metal shell 20. The packing 81 is an annular plate member formed from a metal material such as iron or steel. The recess 83 is formed on, of the step portion 14 of the insulator 11, a first portion 82 contacting with the packing 81. In the present embodiment, the recess 83 is a groove having a quadrangular sectional shape and formed continuously over the entire circumference of the first portion 82.

A projection 87 which at least partially overlaps the recess 83 in the axial-line direction is formed on, of the ledge portion 26 of the metal shell 20, a second portion 86 contacting with the packing 81. In the present embodiment, the projection 87 is a ridge having a quadrangular sectional shape and formed continuously over the entire circumference of the second portion 86.

When the step portion 14 of the insulator 11 is engaged with the ledge portion 26 of the metal shell 20 via the packing 81, the projection 87 is thrusted into the packing 81, and a part of the packing 81 pushed by the projection 87 enters the recess 83. Thus, radial-direction movement of the packing 81 relative to the ledge portion 26 is prevented, whereby radial-direction movement of the insulator 11 relative to the packing 81 can be prevented.

A minimum value T1 in the thickness direction of the insulator 11 at the position of the recess 83 is the radial-direction distance between the axial hole 12 (see FIG. 1) and a part of the recess 83 that is closest to the axial hole 12. The minimum value T1 is greater than a thickness T2 of the insulator 11 at an intersection 89 of the outer circumferential surface of the insulator 11 and a line perpendicular to the axial line O (see FIG. 1) and passing through a part 88 closest to the axial line O, of the inner circumference of the metal shell 20 on the front side with respect to the recess 83. The thickness T2 is the radial-direction distance between the intersection 89 and the axial hole 12. Since T1>T2 is satisfied, the radial-direction thickness of the insulator 11 at the recess 83 can be ensured, and thus insulation breakdown through the insulator 11 at the position of the recess 83 can be less likely to occur.

A height H of the projection 87 from the second portion 86 is smaller than a depth D of the recess 83 from the first portion 82. An end surface 87*a* of the projection 87 is parallel to the first portion 82. These configurations are the same as those of the spark plug 10 in the first embodiment, and the effects based on these configurations are the same as those in the first embodiment.

Figure 8:
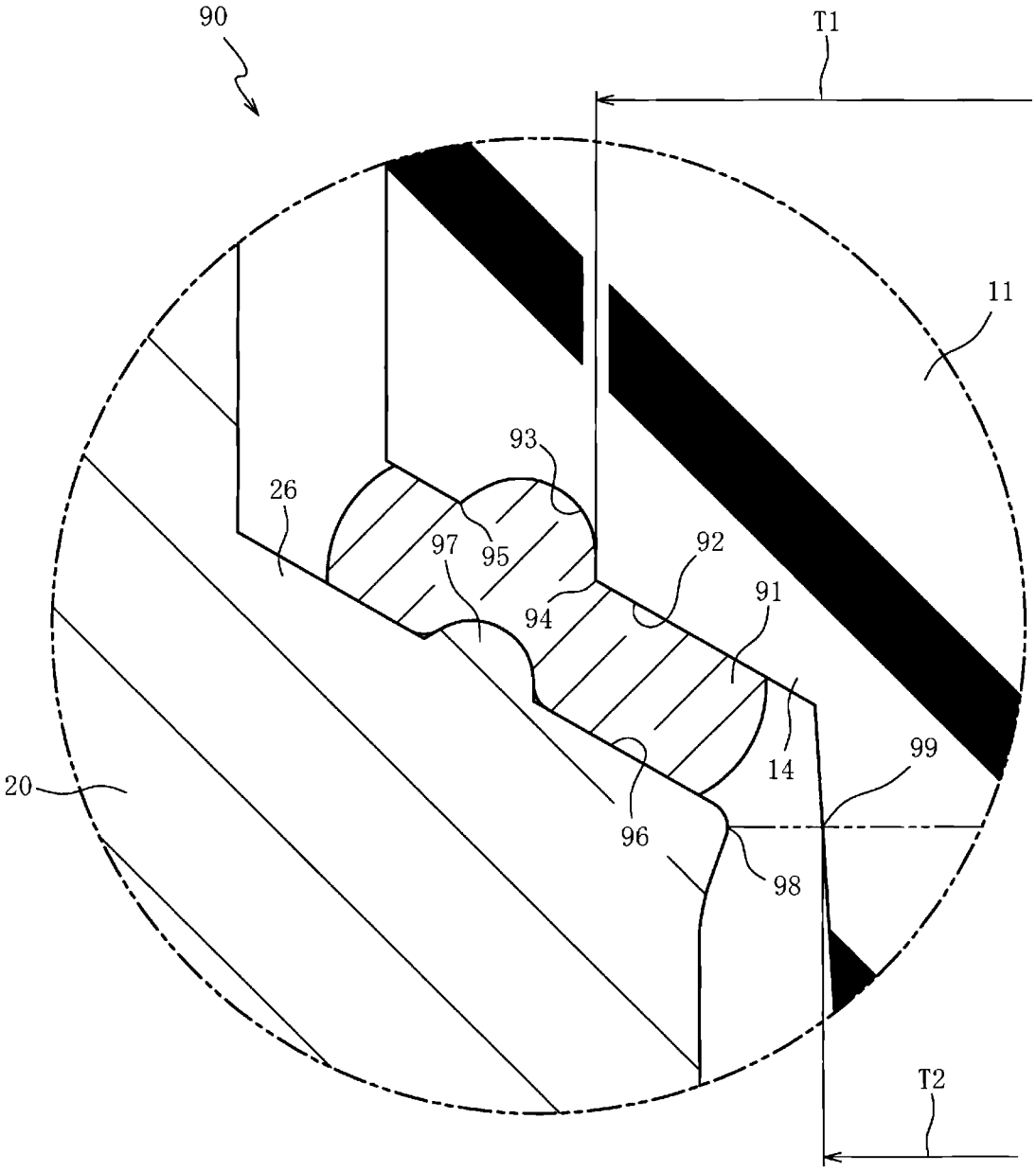
FIG. 8 is a partial sectional view of a spark plug according to the seventh embodiment.

With reference to FIG. 8, the seventh embodiment will be described. In the sixth embodiment, the case where the recess 83 and the projection 87 have quadrangular sectional shapes has been described. On the other hand, in the seventh embodiment, the case where a recess 93 and a projection 97 have semicircular sectional shapes will be described. The same parts as those described in the first embodiment are denoted by the same reference characters and description thereof will not be repeated below. FIG. 8 is a partial sectional view including the axial line O of a spark plug 90 according to the seventh embodiment.

As shown in FIG. 8, in the spark plug 90, a packing 91 is interposed between the step portion 14 of the insulator 11 and the ledge portion 26 of the metal shell 20. The packing 91 is an annular plate member formed from a metal material such as iron or steel. A recess 93 is formed on, of the step portion 14 of the insulator 11, a first portion 92 contacting with the packing 91. In the present embodiment, the recess 93 is a groove having a semicircular sectional shape and formed continuously over the entire circumference of the first portion 92.

A projection 97 which at least partially overlaps the recess 93 in the axial-line direction is formed on, of the ledge portion 26 of the metal shell 20, a second portion 96 contacting with the packing 91. In the present embodiment, the projection 97 is a ridge having a semicircular sectional shape and formed continuously over the entire circumference of the second portion 96. Since the recess 93 and the projection 97 have semicircular sectional shapes, stress concentration on the recess 93 and the projection 97 can be prevented. Thus, occurrence of cracking caused due to the recess 93 and the projection 97 can be prevented, whereby the step portion 14 and the ledge portion 26 can be less likely to be broken.

When the step portion 14 of the insulator 11 is engaged with the ledge portion 26 of the metal shell 20 via the packing 91, the projection 97 is thrusted into the packing 91, and a part of the packing 91 pushed by the projection 97 enters the recess 93. Thus, radial-direction movement of the packing 91 relative to the ledge portion 26 is prevented, whereby radial-direction movement of the insulator 11 relative to the packing 91 can be prevented.

A minimum value T1 in the thickness direction of the insulator 11 at the position of the recess 93 is the radial-direction distance between the axial hole 12 (see FIG. 1) and a part of the recess 93 that is closest to the axial hole 12. The minimum value T1 is greater than a thickness T2 of the insulator 11 at an intersection 99 of the outer circumferential surface of the insulator 11 and a line perpendicular to the axial line O (see FIG. 1) and passing through a part 98 closest to the axial line O, of the inner circumference of the metal shell 20 on the front side with respect to the recess 93.

Therefore, the radial-direction thickness of the insulator 11 at the recess 93 can be ensured and thus insulation breakdown through the insulator 11 at the position of the recess 93 can be less likely to occur.

Although the present invention has been described with reference to the embodiments, the present invention is not limited to the above embodiments at all. It can be easily understood that various modifications can be devised without departing from the gist of the present invention. For example, the sectional shapes and the numbers of the recesses and the projections described in the above embodiments are merely examples and may be set as appropriate.

In the above embodiments, the case where the recess 32, 45, 55, 63, 73, 83, 93 is a groove formed continuously around the axial line O and the projection 36, 49, 59, 67, 75, 87, 97 is a ridge formed continuously around the axial line O, has been described. However, the present invention is not necessarily limited thereto. The recess/projection may be provided in an intermittent form or a scattered form around the axial line O. The number of recesses/projections in this case may be one or plural as appropriate.

In the case of providing a plurality of recesses/projections, not all the plurality of recesses/projections formed on the metal shell 20 need to overlap the recesses/projections formed on the insulator 11, in the axial-line direction. This is because the packing can be prevented from being eccentric, as long as the recesses/projections formed on the insulator 11 overlap a part of the plurality of recesses/projections formed on the metal shell 20. Similarly, it is only necessary that recesses/projections formed on the metal shell 20 overlap a part of a plurality of recesses/projections formed on the insulator 11. Preferably, at least one overlapping part is provided on each of both sides with the axial line O therebetween.

In the case where the recess/projection is formed continuously around the axial line O, the recess/projection formed on the metal shell 20 need not overlap, over the entire circumference, the recess/projection formed on the insulator 11, in the axial-line direction. This is because the packing can be prevented from being eccentric, as long as the recess/projection formed on the insulator 11 overlaps a part of the recess/projection formed on the metal shell 20. Similarly, it is only necessary that a recess/projection formed on the metal shell 20 overlaps a part of a recess/projection formed on the insulator 11. Preferably, at least one overlapping part is provided on each of both sides with the axial line O therebetween.

In the above embodiments, the case where, in the cross section including the axial line O, a segment connecting edges of the recess 32, 45, 55, 63, 73, 83, 93 is separated in the axial-line direction from the projection 36, 49, 59, 67, 75, 87, 97, has been described. However, the present invention is not necessarily limited thereto. The projection 36, 49, 59, 67, 75, 87, 97 may contact with or cross a segment connecting the edges of the recess 32, 45, 55, 63, 73, 83, 93. In the case where the projection 36, 49, 59, 67, 75, 87, 97 contacts with or crosses the above segment, the packing can be thinned and thus the thermal resistance of the packing can be further reduced.

However, even in the case where the projection 36, 49, 59, 67, 75, 87, 97 contacts with or crosses the segment connecting the edges of the recess 32, 45, 55, 63, 73, 83, 93, the packing 30, 41, 51, 61, 71, 81, 91 is interposed between the recess and the projection so that the projection does not contact with the recess. This is because the step portion 14 of the insulator 11 or the ledge portion 26 of the metal shell 20 might be broken if the projection contacts with the recess.

In the above embodiments, the case where the recess and the projection having the same or similar sectional shapes are combined, has been described. However, the present invention is not necessarily limited thereto. As a matter of course, a recess and a projection having different sectional shapes may be combined.

In the above embodiments, the case where the packing contacts with the step portion 14 of the insulator 11 and the ledge portion 26 of the metal shell 20 but does not contact with a part of the insulator 11 on the front or rear side with respect to the step portion 14 and a part of the metal shell 20 on the front or rear side with respect to the ledge portion 26, has been described. However, the present invention is not necessarily limited thereto. As a matter of course, the packing may protrude out from the step portion 14 or the ledge portion 26 so that the packing contacts with the part on the front or rear side with respect to the step portion 14 or the ledge portion 26. Even in this case, a recess is formed on, of one of the step portion 14 and the ledge portion 26, a part (first portion) contacting with the packing, and a projection is formed on, of the other of the step portion 14 and the ledge portion 26, a part (second portion) contacting with the packing.

In the above embodiments, the case where the rear end portion 25 of the metal shell 20 applies an axial-line-direction load to the protruding portion 13 of the insulator 11 via the seal portion 28, has been described. However, the present invention is not necessarily limited thereto. Also in the case where the rear end portion 25 of the metal shell 20 applies an axial-line-direction load to the protruding portion 13 of the insulator 11 without the seal portion 28, the same effects as in the embodiments can be obtained.

In the second embodiment, the case of using the packing 41 having the metal layer 43 formed on the entire surface of the base material 42, has been described. However, the present invention is not necessarily limited thereto. It is only necessary that the metal layer 43 is present on, of the packing 41, a surface (in particular, the surface on which the recess is formed) contacting with the step portion 14 or the ledge portion 26. Therefore, as a matter of course, the packing 41 may be formed by stamping, in an annular shape, a plated steel plate of which the surface is plated, for example.

Each embodiment may be modified by, for example, adding thereto a part or several parts of the configuration of another embodiment, or replacing therewith a part or several parts of the configuration of each embodiment.

For example, as a matter of course, the packing 41 described in the second embodiment may replace the packing in another embodiment to modify the configuration of the other embodiment. Similarly, as a matter of course, the packing 51 described in the third embodiment may replace the packing in another embodiment to modify the configuration of the other embodiment. Further, as a matter of course, the rounded chamfered form applied to the recess 55 and the projection 59 described in the third embodiment may be applied to the edge and/or the corner of the recess and the projection in another embodiment to modify the configuration of the other embodiment.

What is claimed is:

1. A spark plug comprising:

a cylindrical insulator having an axial hole extending in a direction of an axial line from a front side to a rear side, the insulator having, on an outer circumference thereof, a step portion of which an outer diameter reduces toward the front side in the axial-line direction;

a center electrode provided in the axial hole; and a cylindrical metal shell having, on an inner circumference thereof, a ledge portion of which an inner diameter reduces toward the front side in the axial-line direction, the metal shell holding the insulator from an outer circumferential side in a state in which the step portion is engaged with the ledge portion via a packing, wherein a recess is formed on a part contacting with the packing, of one of the step portion and the ledge portion, and a projection which at least partially overlaps the recess in the axial-line direction is formed on a part contacting with the packing, of the other of the step portion and the ledge portion.

2. The spark plug according to claim 1, wherein a height of the projection is smaller than a depth of the recess.

3. The spark plug according to claim 1, wherein the recess is formed on the step portion, and a minimum value of a radial-direction thickness of the insulator at a position of the recess is greater than a radial-direction thickness of the insulator on an inner side of a part closest to the axial line, of an inner circumference of the metal shell on the front side with respect to the recess.

4. The spark plug according to claim 1, wherein the recess is formed on the ledge portion.

5. The spark plug according to claim 4, wherein a center of the recess in a radial direction of the ledge portion is positioned on a radially outer side with respect to a center in the radial direction of the ledge portion.

6. The spark plug according to claim 1, wherein the packing includes a base material and a metal member sandwiched between the base material and the recess formed on one of the step portion and the ledge portion, and Vickers hardness of the metal member is lower than Vickers hardness of the base material.

7. The spark plug according to claim 1, wherein the packing includes a base material and a metal layer formed on at least a part of a surface of the base material, the metal layer is sandwiched between the base material and one of the step portion and the ledge portion on which the recess is formed, and Vickers hardness of the metal layer is lower than Vickers hardness of the base material.

8. The spark plug according to claim 1, wherein an edge and a corner of each of the recess and the projection are chamfered to be rounded.

* * * * *